United States Patent [19]

Dotson

[11] 4,250,491

[45] Feb. 10, 1981

[54] WAITER SIGNAL DEVICE

[76] Inventor: Andy S. Dotson, P.O. Box 252, Pelzer, S.C. 29669

[21] Appl. No.: 84,919

[22] Filed: Oct. 15, 1979

[51] Int. Cl.[3] ..... G08B 5/00; G08B 5/32; G09F 11/00; G09F 15/00

[52] U.S. Cl. ..... 340/321; 362/162; 362/188; 116/202; 116/321; 40/607; 200/60; 200/61.45 R

[58] Field of Search ..... 340/321, 330, 380, 686; 362/32, 84, 154, 162, 188, 190; 116/202, 321, 323; 40/324, 902, 606, 607, 624; 200/51.09, 51.12, 61.53, 61.71, 61.72, 61.74, 61.76, 61.79, 61.8, 60, 61.45 R, 61.49

[56] References Cited

U.S. PATENT DOCUMENTS

| | | | |
|---|---|---|---|
| 2,465,426 | 3/1949 | Bralove | 340/321 |
| 2,563,693 | 8/1951 | Russell | 340/321 |
| 3,071,764 | 1/1963 | Frezieres | 340/321 |

*Primary Examiner*—John W. Caldwell, Sr.
*Assistant Examiner*—Donnie L. Crosland
*Attorney, Agent, or Firm*—Bailey, Dority & Flint

[57] ABSTRACT

A table signal device for signalling for service in a restaurant, lounge and the like includes a signal mechanism which may be raised by the patron to signal for service and lowered by the waiter or waitress upon rendering service to the patron wherein the signal mechanism is illuminated and is highly visible both in lighted and dark rooms.

5 Claims, 5 Drawing Figures

WAITER SIGNAL DEVICE

BACKGROUND OF THE INVENTION

Prior devices have been known such as shown in U.S. Letters Pat. Nos. 2,565,980, 2,638,583 and 3,967,274 disclosing table based devices for signalling for service by means of a lighted signal. However, the problem with signal devices which include only the turning on and off of a light are that they are not highly visible in a lighted room and due to glare, the signal may appear to be on when viewed from certain angles.

Accordingly, an important object of the present invention is to provide a device for signalling a waiter or waitress for service in a restaurant or lounge which provides a highly visible service signal both in a lighted and a darkened room.

Another important object of the present invention is to provide a table signal device which is simple in construction and operation wherein the difference between the signal and non-signal positions of a signal mechanism is highly recognizable by the service attendant.

Yet another important object of the present invention is to provide a table signalling device having a vertically movable signal mechanism which must be raised by the patron for service and lowered by the service attendant after rendering service so that no mistake will be made as to whether service has been completed.

Yet another important object of the present invention is to provide a table signal device having a vertically movable signal mechanism which by itself provides a non-illuminated visual signal when raised to a signalling position in a lighted room and which is automatically illuminated upon reaching the signalling position for providing a highly visual illuminated signal as required by darkness in a room.

SUMMARY OF THE INVENTION

It has been found that a highly effective table signal device can be had according to the invention which provides a highly visual signal for a service attendant in both a lighted and darkened room. The device includes a base, an upstanding hole carried on the base having a widened diameter main section and a reduced diameter tip end section reduced relative to the main section. A slidable signal mechanism is carried on the pole sending a signal for service when raised to adjacent the tip section and having a non-signal position when lowered adjacent the base. Illumination means for illuminating the signal mechanism is provided which is automatically energized with the signal mechanism is raised to its signal position so that the signal mechanism provides a highly visual signal when raised either in a lighted or a darkened room. Manual return of the signal mechanism to its non-signal position by the waiter or waitress assures that no mistake occurs as to whether the service has been rendered.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
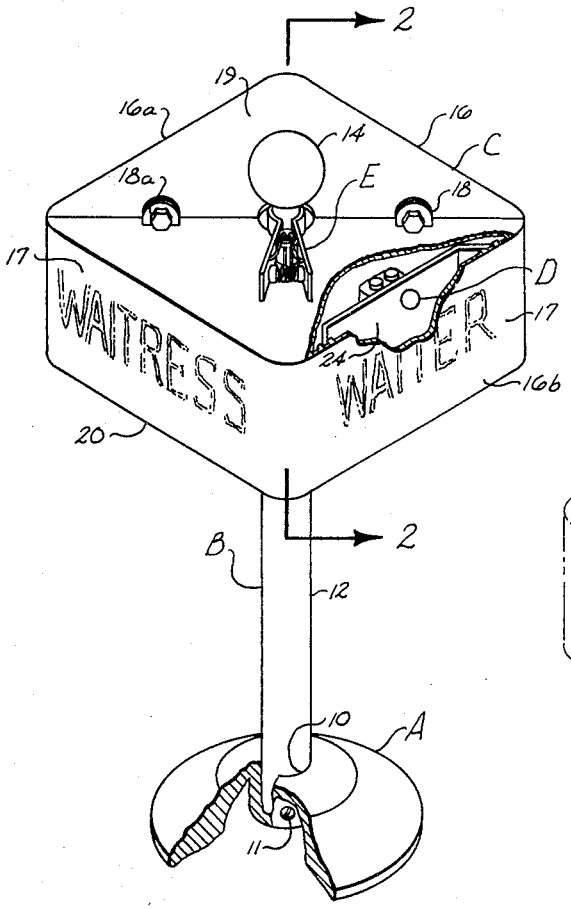
FIG. 1 is a perspective view illustrating a table signal device according to the invention.
Figure 1A:
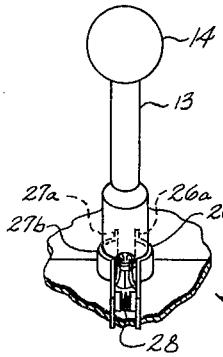
FIG. 1*a* is a cut-away partial perspective view of a switch means in an open position for automatically illuminating the signal mechanism of a table signal device according to the invention.
Figure 3:
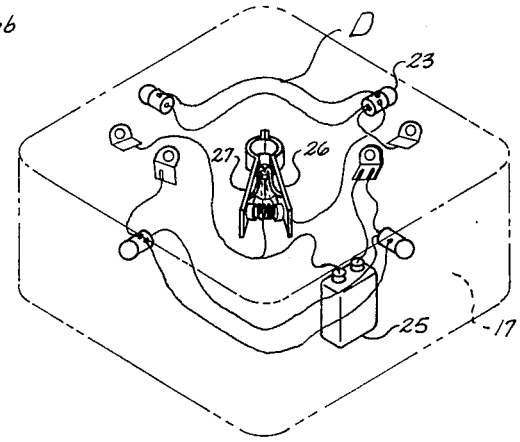
FIG. 3 is a perspective view illustrating illumination means and switch means according to the invention.
Figure 4:
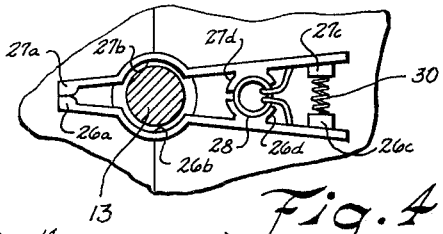
FIG. 4 is an enlarged plan view of a manually operable switch and lock mechanism for a service attendant signal device according to the invention.
Figure 2:
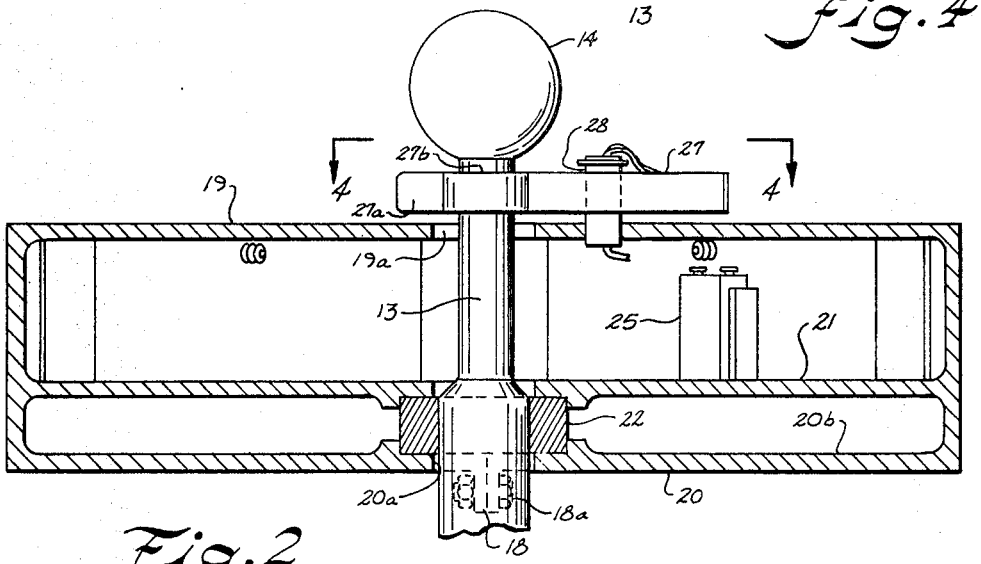
FIG. 2 is a section taken along 2—2 of FIG. 1.

Referring now to the drawing, a table signal device is disclosed for signalling for service in a restaurant or lounge which includes a base A for supporting said device on a table and an upstanding elongated pole B carried by the base terminating at a free tip end. A signal mechanism C is slidably carried by the pole B for vertical movement generally along the entire length thereof whereby the signal mechanism is manually movable between a lowered non-signal position adjacent the base and a raised signal position adjacent the tip end of the pole. The raising of the signal mechanism to its raised position presents the signal mechanism as a signal for service in and of itself. An illumination means E is provided for illuminating the signal mechanism from a suitable power source and a switch means D is provided for activating and energizing the illumination means automatically in response to the signal mechanism C reaching its raised signal position. With the signal mechanism C raised to its signal position, an effective visual service signal is provided in a lighted room while the illumination means illuminates the signal mechanism to provide a visual service signal in a darkened room as well.

The base A may be a self-supporting base made from heavy metal such as lead and the like having a recess 10 in which the pole B may be received and set with a set screw 11. In the alternative, the base A may be made so that it attaches directly to the table to prevent it from being removed. The pole B includes a rod-shaped piece of non-conductive material such as plastic and includes a widened diameter main section 12 and a reduced diameter section 13 formed adjacent the free end thereof. Also at the free end is a stop means 14 in the form of a spherical member for limiting the upward movement of the signal mechanism C.

As illustrated, the signal mechanism C is in the form of a three dimensional box 16 having four planar side surfaces 17 on which a written signal may be displayed. The box is formed from any suitable translucent material so that it may be illuminated from within. Of cource, it is to be understood that other forms of boxes such as round, cylindrical, and the like may also be utilized as signal mechanisms. The box 16 is shown in the form of two half sections 16*a* and 16*b* which are secured together by means of tabs 18 having aperatures therein through which a nut and bolt fastener 18*a* is secured. In the opposing top and bottom surfaces 19 and 20, respectively, opposing aligned holes 19*a* and 20*a* are provided for receiving the pole B. The box includes a pair of bottom panel layers 21 and 20*b* for strength in which is embedded a bearing block member 22 which slidably receives the main diameter section 12 of the pole.

The illumination means D is provided in the form of a conventional light bulb 23 carried at the back side of each side panel which may be carried by a bracket panel 24 on each face panel 17. Power means for energizing the light bulbs 23 is provided in the form of a nine-volt battery 25 or any other form of suitable electrical power may be utilized. The switch means E is provided in the form of a pair of resiliently biased switch arms 26 and 27 pivotally carried about a hollow post 28 through which suitable leads pass and connect the power battery 25 to the contact arms.

A pair of electrical contacts **26*a* and 26*b* are carried at the respective ends of the arms 26 and 27 and contact one another when the switch means is closed for completing the electrical circuit from the battery through the light bulbs 23 energizing the bulbs and illuminating the signal mechanism from within. The switch arms 26 and 27 may be made from a conductive material to complete the circuit from the leads through the closed contacts. At the opposing ends of the switch arms 26 and 27 is a spring 30 biasing the contacts 26*a* and 27*a* to a closed contacting position. It can be seen that the contacts will be closed when a recessed portion 26*b* and 27*b* of the switch arms surrounds the reduced diameter section 13. The contacts 26*a* and 27*a* will be biased open by contact with pole B when the recessed portions 26*b* and 27*b* surround the main diameter section 12 of the pole. Thus, the illumination means will be automatically illuminated when the signal box C is raised to the signal position by the patron. Subsequently after service has been rendered, the waitress or waiter may release the signal box C and return it to its non-signal position by squeezing the switch arms 26 and 27** rearwardly to unlock the box from its signal position and return it downwardly to its non-signal position.

While the switch means E has been illustrated in the form of a pair of arms which both pivot about the pin 28, it is to be understood that one of the arms may be fixed with the remaining switch arm being resilient so as to pivot and release from the diameter 13 in the signal position. It will be noted that switch means E provides the additional result of locking the signal mechanism C in its raised signal position with recesses **26*b* and 27*b* biased closed about the reduced section 13**.

Thus, it can be seen that an advantageous construction can be had for a waiter or waitress signal device whereby a patron may signal for service in a lighted or a darkened room by raising the signal box to a signal position automatically illuminating the box with the signal produced being equally visible in a lighted room or a darkened room.

While a preferred embodiment of the invention has been described using specific terms, such description is for illustrative purposes only, and it is to be understood that changes and variations may be made without departing from the spirit or scope of the following claims.

What is claimed is:

1. A table signal device for signalling a service attendant in a restaurant or lounge and the like comprising:

a base for supporting said device on a table;

an upstanding elongated pole carried by said base terminating at a free tip end;

a signal mechanism slidably carried by said pole for movement generally along the entire length thereof;

said signal mechanism being manually movable between a lowered non-signal position adjacent said base and a raised signal position adjacent said tip end of said pole;

said raised signal position presenting said signal mechanism as a signal for service;

illumination means carried by said signal mechanism;

power means for energizing said illumination means; and switch means for activating said power means to energize said illumination means automatically in response to said signal mechanism reaching said raised signal position;

whereby said raised signal mechanism provides a visual service signal in a lighted room while said illumination means illuminates said signal mechanism to provide a visual service signal as required by darkness in a room.

2. The device of claim 1 wherein said signal mechanism includes a three-dimensional box having aperatures formed in opposing surfaces for receiving said pole therethrough and a central bearing bore slidably received over said pole.

3. The device of claim 1 wherein said upstanding pole includes a main diameter section with said tip end section being reduced in diameter relative to said main diameter section; and wherein said switch means includes a pair of contacts with at least one of said contacts being carried on a resilient switch arm, said switch arm being biased by engagement with said pole in said main diameter section to maintain said contacts open and said reduced diameter tip section enabling said contacts to close.

4. The device of claim 3 wherein said switch arm is biased towards said pole and provides a lock when biased against said reduced tip section to aid in retaining said signal mechanism in said signal position.

5. The device of claim 1 including a stop carried at said tip end of said pole limiting the upward movement of said signal mechanism.

* * * * *